US008556186B2

(12) United States Patent
Sand

(10) Patent No.: US 8,556,186 B2
(45) Date of Patent: Oct. 15, 2013

(54) FAIL SAFE ENGINE COOLANT THERMOSTAT

(76) Inventor: Darrel Sand, Okemos, MI (US)

( * ) Notice: Subject to any disclaimer, the term of this patent is extended or adjusted under 35 U.S.C. 154(b) by 728 days.

(21) Appl. No.: 12/777,641

(22) Filed: May 11, 2010

(65) Prior Publication Data

US 2010/0282191 A1 Nov. 11, 2010

Related U.S. Application Data

(60) Provisional application No. 61/177,050, filed on May 11, 2009.

(51) Int. Cl.
*F01P 7/16* (2006.01)
*G05D 23/08* (2006.01)

(52) U.S. Cl.
USPC ..... 236/34; 236/101 E; 236/101 R

(58) Field of Classification Search
USPC ..... 123/41.09; 236/101 E, 101 R, 34.5, 34; 137/15.25
See application file for complete search history.

(56) References Cited

U.S. PATENT DOCUMENTS

| | | | | |
|---|---|---|---|---|
| 2,815,174 | A * | 12/1957 | Rimsha | 236/34 |
| 3,045,918 | A | 7/1962 | Woods | |
| 3,498,537 | A | 3/1970 | Wong | |
| 4,031,872 | A | 6/1977 | Thompson et al. | |
| 4,134,540 | A * | 1/1979 | Lagher | 236/34.5 |
| 4,142,676 | A * | 3/1979 | Hattori | 236/87 |
| 4,245,782 | A | 1/1981 | Brown | |
| 4,345,234 | A * | 8/1982 | Reich | 337/336 |
| 4,453,668 | A | 6/1984 | Abel | |
| 4,469,275 | A | 9/1984 | DeSalve | |
| 4,475,684 | A | 10/1984 | Garlick et al. | |
| 4,524,907 | A | 6/1985 | Wong | |
| 4,883,225 | A | 11/1989 | Kitchens | |
| 4,942,849 | A | 7/1990 | Shelton | |
| 5,111,775 | A | 5/1992 | Sumida et al. | |
| 5,140,951 | A | 8/1992 | Carr | |
| 5,207,744 | A | 5/1993 | Heafner | |
| 5,361,980 | A | 11/1994 | Stout | |
| 5,381,952 | A | 1/1995 | Duprez | |
| 5,419,488 | A | 5/1995 | Saur et al. | |
| 5,738,276 | A * | 4/1998 | Saur | 236/92 C |
| 5,813,598 | A | 9/1998 | Kim | |
| 5,979,373 | A | 11/1999 | Sano | |
| 7,478,762 | B2 * | 1/2009 | Conlin | 236/101 D |
| 7,490,581 | B2 | 2/2009 | Fishman | |
| 2003/0150923 | A1 | 8/2003 | Leu | |
| 2010/0212612 | A1 * | 8/2010 | Vacca et al. | 123/41.09 |

FOREIGN PATENT DOCUMENTS

EP 781964 A1 * 7/1997

* cited by examiner

*Primary Examiner* — Marc Norman
(74) *Attorney, Agent, or Firm* — Young, Basile, Hanlon & MacFarlane, P.C.

(57) ABSTRACT

A fail safe engine coolant thermostat includes a body having a bore with an inlet and an outlet. An actuator exposed to coolant fluid and capable of movement based on coolant temperature is disposed in the body. A valve plate is pivotally mounted in the body to open and close fluid flow through the body outlet. A connecting member is coupled between the actuator and the valve plate to pivot the valve plate between fluid flow open and closed positions. The pivot connection of the valve plate is diametrically off center to define a large surface area and a smaller surface area on opposite sides of the pivot connection such that, in absence of a connection between the actuator, the connecting member and the valve plate, the valve plate pivots to the fluid flow open position under the influence of coolant fluid flow through the body.

9 Claims, 2 Drawing Sheets

FAIL SAFE ENGINE COOLANT THERMOSTAT

CROSS REFERENCE TO CO-PENDING APPLICATION

This application claims priority to the benefit of the May 11, 2009 filing date of co-pending U.S. Provisional Patent Application Ser. No. 61/177,050, in the name of Darrell R. Sand, the entire contents of which are incorporated herein by reference.

BACKGROUND

The present disclosure relates, in general, to vehicle cooling system thermostats.

A thermostat is employed in vehicle cooling systems to control the flow of engine coolant to a heat exchanger or radiator. The thermostat is normally closed blocking flow to the radiator immediately after an engine is started when the engine coolant is at a relatively low or cold temperature. When a predetermined higher or hot temperature is reached, the thermostat opens allowing coolant to flow to the radiator to take advantage of the heat exchange properties of the radiator so as to maintain the engine coolant at a substantially constant temperature during continuous engine operation.

While thermostats are usually reliable in operation, they can still fail. A typical thermostat failure results in the thermostat being disposed in the coolant a flow blocking position preventing coolant flow to the radiator. This can lead to catastrophic engine failure due to extreme engine overheating.

It would be desirable to provide a fail safe engine coolant thermostat which, in the event of a thermostat failure, still allows engine coolant flow to the radiator.

SUMMARY

A fail-safe thermostat for controlling coolant flow between an engine and a radiator that has a body with a bore extending between an inlet and an outlet. The body is adapted to be coupled between the engine and the radiator flow path. A thermally responsive actuator is disposed in the body and exposed to coolant fluid flow. The actuator is capable of assuming extended and retracted positions. A valve plate is pivotally mounted in the body in a location to open and close fluid flow from the inlet to the outlet. A connecting member is coupled between the thermal actuator and the valve plate to pivot the valve plate between a fluid flow, open position and a fluid flow closed position relative to the outlet in the body in the response to the extended and retracted positions of the thermoactuator.

The pivotal connection to the valve plate to the body is connected off center from a diametrical center line through the valve plate to define a larger surface area on the valve plate to one side of the pivot connection and a smaller surface area of the valve plate to the opposed side of the pivot connection whereby, in absence of a continuous workable connection between thermally responsive actuator, the connecting member and the valve plate, the valve plate can freely pivot to the open position allowing coolant flow to the engine under the influence of the force of the coolant flow differential on the larger and smaller surface area portions of the valve plate.

The connecting member maybe pivotally connected to the valve plate and the thermally responsive actuator.

The thermal actuator can be a stack of bi-metal material leaves.

A valve seat is defined in the body for the closed position of the valve plate. A flange is part of the body and includes a channel defining the outlet of the body. The seat is defined by edges of the channel and the flange.

BRIEF DESCRIPTION OF THE DRAWING

The various features, advantages and other uses of the present fail safe engine coolant thermostat will become more apparent by referring to the following detailed description and drawing in which.

DETAILED DESCRIPTION

Figure 1:
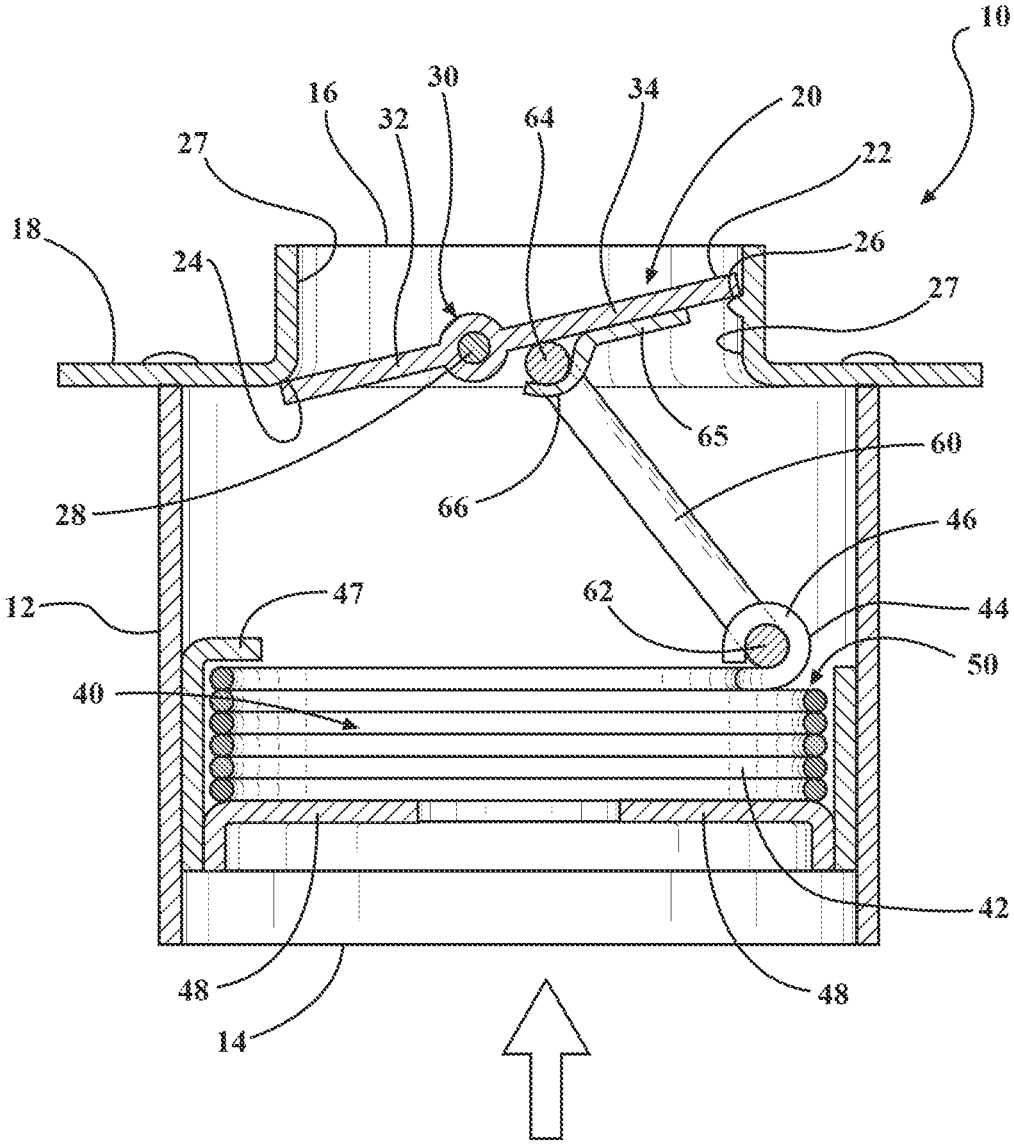
FIG. 1 is a cross sectional view of a fail safe thermostat shown in the flow blocking, closed position.
Figure 2:
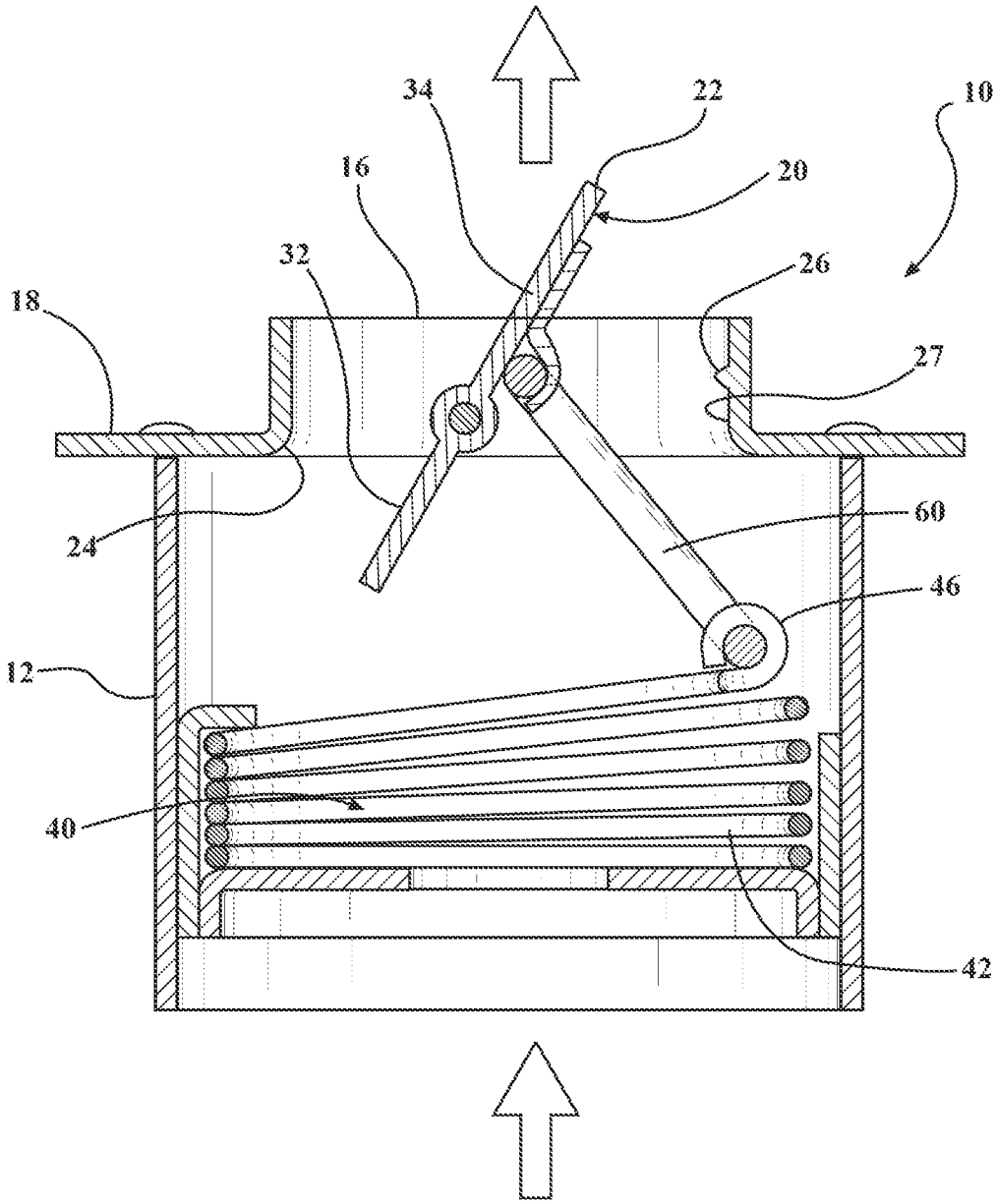
FIG. 2 is a cross sectional view of the fail safe thermostat shown in FIG. 1; but with the thermostat valve depicted in the flow allowing, open position.

Referring now to FIGS. 1 and 2, there is depicted a fail safe engine coolant thermostat 10 which is configured for fail safe operation so as to be disposed in a normally opened, coolant flow allowing position in the event of a mechanical failure of a component of the thermostat 10.

The thermostat 10 includes an outer body 12 having an inlet 14 and an outlet 16. The body 12 is mounted or fluidically coupled to an engine coolant flow passage way so as to be in the coolant flow path from the engine to the radiator or engine heat exchanger. A mounting flange 18 may be coupled to one end or integrally formed as a unitary part of the body 12 to facilitate mounting of the thermostat 10 in a vehicle engine.

The thermostat 12 includes a valve 20 which is in a form of a butterfly valve having a substantially circular valve plate 22. The plate 22 has a generally planar configuration with an outer diameter sized to sealingly engage valve seat surfaces 24 and 26 formed about a channel 27 in the mounting flange 18. The outer diameter of the valve plate 22 is sized to sealingly close off and block fluid flow through the channel 27 in the mounting flange 18 within the thermostat outlet 16.

The plate 22 is pivotally mounted within the body 12 or mounting flange 18 by means of a pivot pin 28 extending through an enlarged intermediate of a pivot connection 30 integrally formed with or attached to the plate 22.

In the present fail safe thermostat 10, the plate 22 is pivotally coupled to the mounting flange 18 in a lateral off center position. Due to this off center pivot connection, as shown in FIG. 1, one side portion 32 of the plate 22 to one side of the pivot pin 28 is smaller than the opposite side portion 34 extending from an opposite direction from the pivot pin 28.

A thermally responsive actuator 40 is mounted within the thermostat body 12. The thermally responsive actuator 40 can be any thermally responsive component which is capable of exhibiting movement, either expansion or contraction or in axial or linear directions, in response to temperature changes, such as the temperature of an engine coolant flowing through and around the actuator 40.

By way of example only, the thermally responsive actuator 40 is depicted as being formed of a plurality of bi-metal material leaves 42. The bimetal material leaves 42 may be individual leaves arranged in a stack or a spiral, coil arrangement of a single continuous strip of bimetal material. The bimetal material leaves 42, as explained above, have a hollow bore providing a coolant flow bore between the inlet 14 and outlet 16 of the thermostat body 12.

One of the bimetal material leaves 42 has an end portion 44 formed in a turned over loop 46.

The bimetal leaves 42 are fixedly and non-movably constrained along one side edge or end by a pair of flanges 47 and 48 joined together and/or otherwise fixed with respect to the thermostat body 12. The diametrically opposite side edges of the bimetal material leaves 42 seat on one mounting flange 48 which itself is fixed to the thermostat body 12. This arrangement allows the side edges 50 of the bimetal material leaves 42 to exhibit expansion and contraction movement as shown in the difference between the position of the bimetal leaves 42 in FIGS. 1 and 2.

At a low engine coolant temperature, which is typical of the temperature of the engine coolant immediately after the engine is started, the bimetal material leaves 42 are in their completely retracted position forming a substantially contiguous stack shown in FIG. 1 However, when the engine coolant temperature reaches a predetermined higher or hot temperature, the bimetal material leaves 42 expand. Since one side edge of the bimetal leaves 42 is restrained between the mounting flanges 47 and 48, only the opposed end portions 50 will exhibit movement between the first and second positions shown in FIGS. 1 and 2, respectively.

A connecting member or link 60 is coupled between the valve plate 22 and the bimetal stack. By way of example only, the connecting member 60 is in the form of a rod having a first outwardly bent end 62 coupled to the loop 46 in one end of the bimetal material leaves 42 and an opposite bent end 64 which is coupled to a loop 66 formed in a flange 65 fixedly coupled to the valve plate 22.

The engagement of the ends 62 and 64 of the connecting member or rod 60 and the valve plate 22 couples expansion and contraction of bimetal material leaves 42 in response to changes in engine coolant temperature to pivotal movement of the valve plate 22 between the first coolant flow blocking or closed position shown in FIG. 1 and the second coolant flow allowing, open position shown in FIG. 2.

In operation, when the engine is off or has just been started, the temperature of the engine coolant is normally at a low or "cold" temperature. This temperature causes the bimetal material leaves 42 to contract into the closely arranged stack shown in FIG. 1. This contraction results in movement of the loop 46 on the edge of one of the bimetal material leaves 42 in a downward direction in the orientation of the thermostat 10 shown by way of example in FIG. 1. This downward movement enables the rod 60 to pull the valve plate 22 to the closed, coolant flow blocking position depicted in FIG. 1. In this closed position, the outer periphery or edges of the valve plate 22 sealingly engage the seat surfaces 24 and 26 on the mounting flange 18 of the thermostat body 12 to prevent fluid flow from the inlet 14 through the outlet 16 of the thermostat 12 to the engine radiator.

When the engine coolant temperature rises to a predetermined or so call "hot" temperature, the bimetal material leaves 42 expand. Since one side edge of the bimetal material leaves 42 is restrained from movement by the mounting flanges 46 and 48, the opposite end of the bimetal material leaves 42 carrying the loop 46 is allowed to expand in the direction shown in the difference between the position of the loop 46 in FIGS. 1 and 2. This movement, through the rod 60, pushes the off center mounted valve plate 22 to the fluid flow allowing, open position depicted in FIG. 2 which coolant flow is allowed to exit the outlet 16 of the thermostat 10 and flow to the engine heat exchanger or radiator.

When the engine is turned off, and the temperature of the engine coolant decreases back toward the "cold" temperature, the moveable ends of the bimetal material leaves 42 will contract moving rod loop 46 in a downward direction back to the position shown in FIG. 1. This downward movement causes the rod 60 to exert a pulling force on the valve plate 22 causing the valve plate 22 to pivot from the open position shown in FIG. 2 back to the closed position shown in FIG. 1.

A typical failure mode for the thermostat 10 will be a mechanical failure or breakage of any one or more of the mechanical connections of the rod ends 62 and 64 to the bimetal material leaves loop 46 or to the valve plate 22 thereby disconnecting contraction and expansion of the bimetal material leaves 42 from the valve plate 22.

However, the unique off center pivot mounting of the valve plate 22 relative to the pivot pin 28 enables pressurized fluid flow through the thermostat body 12 to act on the side portions 32 and 34 of the valve plate 22 in an unequal manner such that the coolant flow impurging on the larger surface area of the side portion 34 will create a greater pivotal force on the valve plate 22 than the force exerted by the fluid flow on the smaller portion 32 of the valve plate 22. This unequal force distribution enables the valve plate 22 to freely pivot about the pivot pin 28 toward the open position shown in FIG. 2 allowing coolant to continue to flow to the radiator and preventing a catastrophic engine overheating condition.

What is claimed is:

1. A fail safe engine coolant thermostat comprising:

a housing adapted to be mounted in an engine coolant flow passageway;

a valve plate mounted in the housing movable between a coolant flow blocking and a coolant flow allowing positions in the housing, the valve plate coupled to the housing in a position tending to allow the valve plate to normally pivot to the fluid flowing allowing position;

a thermal responsive actuator mounted in the housing;

a connector coupled between the thermal responsive actuator and the valve plate to move the valve plate to the flow blocking position at a low coolant temperature to move and the valve plate to the fluid flow allowing position at a higher coolant temperature; and a pivot connection of the valve plate to the body being connected diametrically off center to define a larger surface area on the valve plate to one side of the pivot connection and a smaller surface area of the valve plate to the opposed side of the pivot connection whereby, in absence of a workable connection between thermal responsive actuator, the connecting member and the valve plate, the valve plate can freely pivot to the coolant flow allowing position under the influence of the force of the coolant flow differential on the larger and smaller surface area portions of the valve plate.

2. The fail safe engine coolant temperature of claim 1 wherein:

the thermal responsive actuator including a stack of bimetal material leaves.

3. The fail safe engine coolant thermostat of claim 2 wherein:

the connector coupled between the valve plate and the end of the bimetal material leaves capable of exhibiting movement in response to fluid flow temperature variations.

4. A fail safe engine coolant thermostat comprising:

a housing adapted to be mounted in an engine coolant flow passageway;

a valve mounted in the housing movable between a coolant flow blocking and a coolant flow allowing positions in the housing, the valve coupled to the housing in a position tending to allow the valve to normally pivot to the fluid flowing allowing position;

a thermal responsive actuator mounted in the housing the thermal responsive actuator including a stack of bimetal material leaves;

a connector coupled between the thermal responsive actuator and the valve to move the valve to the flow blocking position at a low coolant temperature and moves the valve to the fluid flow allowing position at a higher coolant temperature;

the connecting member is pivotally connected to the valve and the thermal responsive actuator;

a pivot connection of a valve plate of the valve to the body being connected off center from a diametrical center line through the valve plate to define a larger surface area on the valve plate to one side of the pivot connection and a smaller surface area of the valve plate to the opposed side of the pivot connection whereby, in absence of a workable connection between the thermal responsive actuator, the connecting member and the valve plate, the valve plate can freely pivot to the fluid flow allowing position allowing coolant flow to the engine under the influence of the force of the coolant flow differential on the larger and smaller surface area portions of the valve plate; and wherein one side of the bimetal material leaves is constrained from movement and the opposite end of the bimetal material leaves is freely, movably disposed in the housing.

5. A thermostat controlling coolant flow between an engine and a radiator comprising:

a body having a bore extending between an inlet and an outlet, the body adapted to be coupled between the engine and the radiator flow path;

a valve plate pivotally mounted in the body in a position to open and close fluid flow from the inlet to the outlet;

a thermally responsive actuator disposed in the body and exposed to coolant fluid flow and capable of assuming extended and retracted positions;

a connecting member coupled between the thermally responsive actuator and the valve plate to pivot the valve plate between fluid flow open and fluid flow closed positions relative to the outlet in the body in the response to the extend and retracted positions of the thermally responsive actuator; and a pivot connection of the valve plate to the body being connected diametrically off center to define a larger surface area on the valve plate to one side of the pivot connection and a smaller surface area of the valve plate to the opposed side of the pivot connection whereby, in absence of a workable connection between the thermally responsive actuator, the connecting member and the valve plate, the valve plate can freely pivot to the open position allowing coolant flow to the engine under the influence of the force of the coolant flow differential on the larger and smaller surface area portions of the valve plate.

6. The thermostat of claim 5 wherein:

the connecting member is pivotally connected to the valve plate and the thermally responsive actuator.

7. The thermostat of claim 5 wherein:

the thermally responsive actuator defines a stack of bimetal material leaves.

8. The thermostat of claim 5 wherein:

a valve seat is defined in the body for the close position of the valve plate.

9. The thermostat of claim 8 further comprising:

a flange on the body, the flange including a channel defining the outlet of the body; and the valve seat defined by edges of the channel and the flange.

* * * * *